US006514386B2

(12) United States Patent
Watanabe

(10) Patent No.: US 6,514,386 B2
(45) Date of Patent: Feb. 4, 2003

(54) PAPERMAKING FELT

(75) Inventor: Kazumasa Watanabe, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 09/877,863

(22) Filed: Jun. 8, 2001

(65) Prior Publication Data

US 2002/0060045 A1 May 23, 2002

(30) Foreign Application Priority Data

Jun. 19, 2000 (JP) ..... 2000-183827

(51) Int. Cl.[7] ..... D21F 7/08

(52) U.S. Cl. ..... 162/358.2; 162/900; 428/152

(58) Field of Search ..... 162/204, 205, 162/306, 358.1, 358.2, 358.4, 900, 902, 903; 139/383 AA, 425 A; 28/110; 428/105, 112, 119, 152, 163, 154, 212; 442/50, 268, 270, 183, 286, 326

(56) References Cited

U.S. PATENT DOCUMENTS

| | | | | | |
|---|---|---|---|---|---|
| 4,541,895 | A | * | 9/1985 | Albert | 162/348 |
| 4,687,697 | A | * | 8/1987 | Cambo et al. | 428/201 |
| 4,781,967 | A | * | 11/1988 | Legge et al. | 428/109 |
| 5,204,171 | A | * | 4/1993 | Eschmann | 442/195 |
| 6,071,837 | A | * | 6/2000 | Crook | 442/268 |
| 6,140,260 | A | * | 10/2000 | Johnson et al. | 442/270 |

FOREIGN PATENT DOCUMENTS

JP 4-57987 2/1992

* cited by examiner

*Primary Examiner*—Steven P. Griffin
*Assistant Examiner*—Eric Hug
(74) *Attorney, Agent, or Firm*—Howson and Howson

(57) ABSTRACT

A papermaking felt which offers excellent elasticity over a long duration comprises a base body (2) and batt layers (3), and a film layer (5) with elongate ridges (4) having their orientation in the CMD direction. The film is arranged in the base body, in the batt layers, or between the layers. The papermaking felt is capable of running flexibly and smoothly in a winding path of a papermaking machine, and is highly resistant to flattening through fatigue, even if subjected to repeated compression under the nip pressure.

6 Claims, 9 Drawing Sheets

FIG.10

Property of Mobilon Film

| Item \ Product No. | | Unit: M | MF100-T | MF300-T |
|---|---|---|---|---|
| Thickness | | μ | 100 | 300 |
| Density | | | 1.08 | |
| Hardness | | HS | 78 | |
| Softening point | | ℃ | 100 | |
| Brittling temperature | | ℃ | <-70 | |
| Oxygen index | | | 21 | |
| Abrasion loss (TABER method) | | mg | 20 | |
| Strength at break | Lengthwise | $kg/cm^2$ | 800 | 700 |
| | Widthwise | $kg/cm^2$ | 800 | 700 |
| Elongation at break | Lengthwise | % | 600 | 650 |
| | Widthwise | % | 650 | 650 |
| Tear strength | Lengthwise | kg/cm | 85 | 80 |
| | Widthwise | kg/cm | 85 | 80 |
| Stress at elongation | Lengthwise | $kg/cm^2$ | 50 | 45 |
| | Widthwise | $kg/cm^2$ | 45 | 45 |
| Water permeability ($g/m^3 \cdot 24hr$) | | | 900 | 300 |
| Gas permeability $\frac{cm^3 \cdot mm}{mm^2 \cdot 24hr \cdot atm}$ | $O_2$ | | 380 | |
| | $CO_2$ | | 5500 | |
| | Air | | 230 | |
| Low temperature Resistance (Elongation at break) | -40℃ | % | 500 | |
| | -60℃ | % | 350 | |
| | -100℃ | % | 250 | |
| | -150℃ | % | 5 | |

FIG. 11

| Example | 1 | 2 | 3 | 4 | 5 | 6 | Comparative Example 1 |
|---|---|---|---|---|---|---|---|
| Film layer | MF100-T | | | MF300-T | | | |
| Total areal weight of papermaking felt ($g/m^2$) | 990 | 990 | 990 | 1070 | 1070 | 1070 | 1070 |
| Areal weight of base body ($g/m^2$) | 300 | 300 | 300 | 300 | 300 | 300 | 440 |
| Areal weight of batt layer ($g/m^2$) | 550 | 540 | 525 | 400 | 390 | 380 | 550 |
| Areal weight ratio of film layer to base body (%) | 46 | 50 | 110 | 123 | 127 | 130 | 0 |
| Ranking of fatigue resistance | 6 | 5 | 3 | 3 | 1 | 1 | 7 |
| Water permeability | excellent | excellent | good | good | fair | fair | Excellent |

PAPERMAKING FELT

FIELD OF THE INVENTION

This invention relates to a papermaking felt, and especially to a paper-making felt which is excellent in duration of elasticity.

BACKGROUND OF THE INVENTION

In general, a papermaking machine is adapted to squeeze water from a wet web by sandwiching the wet web and the web-carrying felt between a pair of press rolls. Thus, a papermaking felt is subjected to pressure along its path at relatively short intervals, causing the felt to lose elasticity gradually by fatigue due to the repeated compression. Ultimately, the papermaking felt becomes flat, and loses its water-squeezing function. Therefore, for a papermaking felt, the duration of its elasticity is especially important.

In Japanese Patent Application No. 166700/1990, the inventor had proposed previously a papermaking felt which met the above-mentioned demand for duration of elasticity. In that proposal, as shown in FIG. 12, a papermaking felt 30 consists of a ground fabric layer 31 of a woven fabric, a batt layer 32, and a non-woven fabric layer 33. The second batt layer 32' is accumulated on the non-woven fabric layer 33, and the second non-woven fabric layer 33' is arranged on the surface of the second batt layer 32'. The non-woven fabric layer 33 and the second non-woven fabric layer 33' are composed of polyelastomer, which is an elastic material, thereby providing an improvement in the duration of the elasticity of the felt.

Prior efforts to improve the duration of the elasticity of a papermaking felt have encountered problems in papermaking machines of the high speed, high pressure type which have appeared in recent years. The elasticity of the felt could not be sustained satisfactorily over a long period of time, though the duration of elasticity was good when compared with that of former papermaking felts subject to repeated compression at the nip.

An important object of this invention is to solve the above-mentioned problem. The purpose of the invention is to provide a papermaking felt which offers excellent duration of elasticity even in a papermaking machine of high speed and high pressure type.

SUMMARY OF THE INVENTION

To address the aforementioned object, a preferred papermaking felt in accordance with the invention comprises a base body and batt layers, and is characterized in that a film layer, formed with elongate ridges having an orientation in the CMD direction, is arranged in the base body, in the batt layers, or between the batt layers. The term "CMD" refers to a direction orthogonal to the "MD" direction, the latter being the direction in which the papermaking felt of the invention runs. Owing to the film layer, it is possible to run the felt flexibly and smoothly in the winding path in a paper making machine, and the felt resists the tendency to be rendered flat under the nip pressure, which tends to cause fatigue in papermaking felts through repeated compression.

A preferred papermaking felt in accordance with the invention is characterized in that the above-mentioned film layer consists of an elastic material. When the film layer is composed of an elastic material, it causes the initial elasticity of the papermaking felt to be maintained for a longer time.

The elongate ridges of the film layer, oriented in the CMD direction, may be formed by creping, in which case, the structure is such that the elongate ridges may be arranged irregularly, with the height of their peaks and their lengths made random by the forming process itself.

Alternatively, the elongate ridges of the film layer, oriented in the CMD direction, may be formed by embossing, in which case the structure is such that the elongate ridges may be formed easily with a reasonable manufacturing cost.

BRIEF DESCRIPTION OF THE DRAWINGS

FIG. 4(*b*) is a perspective view depicting a film layer having elongate ridges formed by embossing, in which the ridges are formed on both sides of the film;

FIG. 7(*b*) is a perspective view of a film layer with elongate ridges formed by tubes which are split in half;

FIG. 10 is a table showing physical properties of the film layer in certain exemplary embodiments of the invention;

FIG. 11 is a table comparing certain properties of the exemplary embodiments of the invention with one another and with the properties of a comparative example.

DETAILED DESCRIPTION OF THE PREFERRED EMBODIMENT

Figure 1:
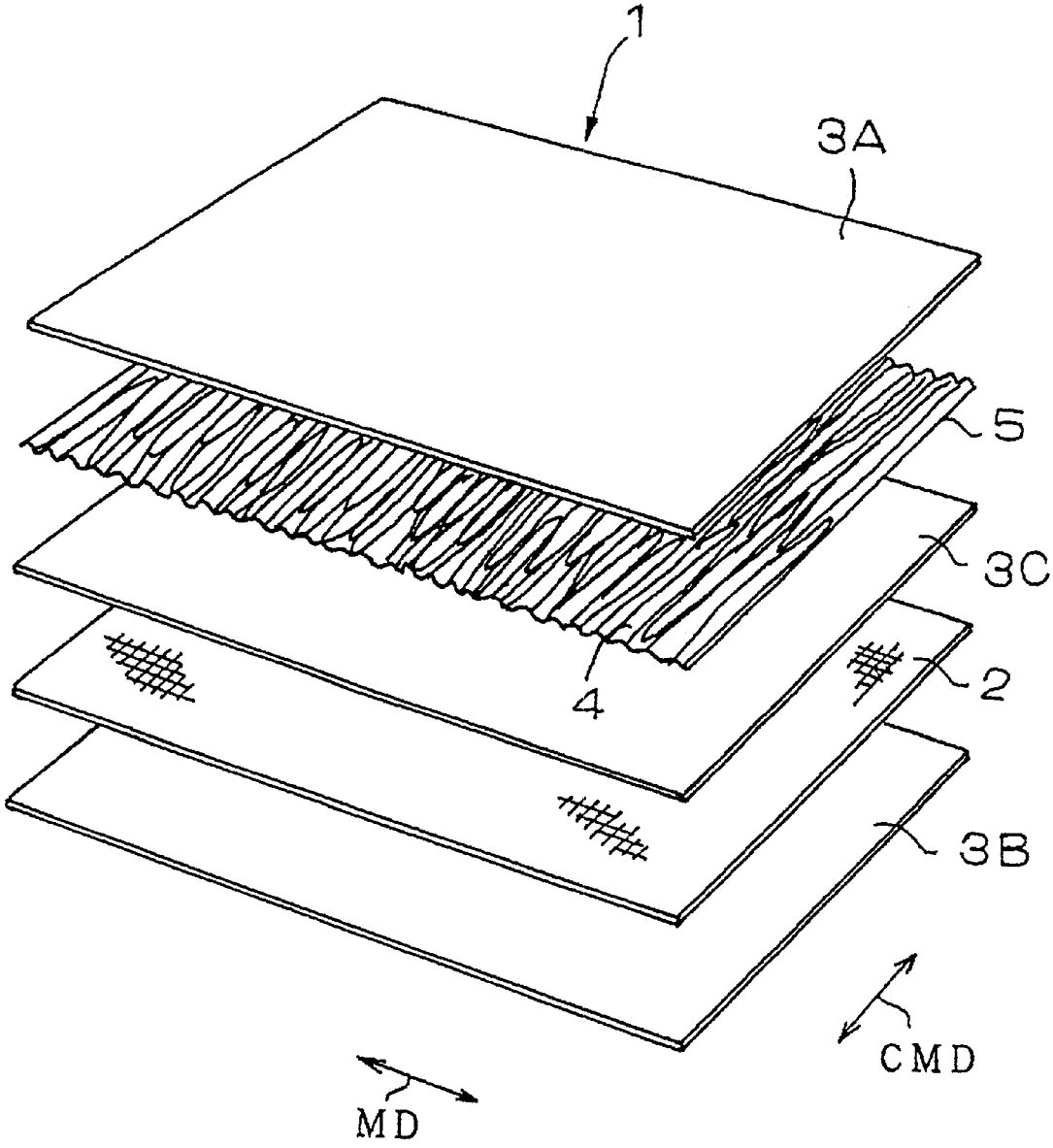
FIG. 1 is a broken-away perspective view of a papermaking felt according to the invention.
Figure 2:
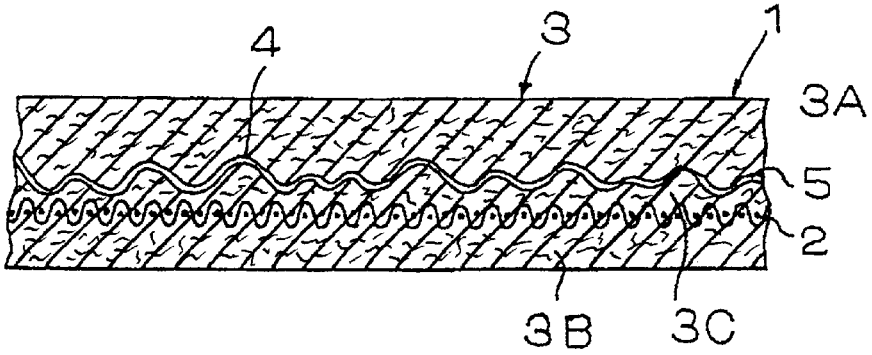
FIG. 2 is a sectional view of a papermaking felt of the invention, taken on a plane parallel to the MD direction.

The paper-making felt 1 of the invention comprises a base body 2 and a composite batt layer 3, as shown in FIGS. 1 and 2. A film layer 5, with elongate ridges 4 oriented in the CMD direction is arranged within the composite batt layer 3. An arrow labeled "CMD" in FIG. 1 shows the CMD direction, and another arrow, labeled "MD" shows the MD direction.

The above-mentioned base body 2 is provided to impart the necessary strength to the papermaking felt. In the embodiment shown in FIGS. 1 and 2, the base body 2 is composed of a woven fabric. The composite batt layer 3, on the other hand, comprises an assembly of short fibers which are intertwined with the base body 2 by needling, and thereby made integral with the base body 2.

The composite batt layer 3 is composed of a first batt layer component 3A on the side which comes into contact with a wet web (not shown); a second batt layer component 3B, which comes into contact with a roll (also not shown); and a third batt layer 3C, which is sandwiched between the film layer 5 and the base body 2. The third batt layer 3C may be composed of short fibers which become removed from the first batt layer 3A and the second batt layer 3B when the needling is carried out. The third batt layer 3C functions to maintain the configuration of the elongate ridges 4 of the film layer 5 from the back side thereof.

The film layer 5 is arranged between the first batt layer 3A and the base body 2 in FIG. 1 and FIG. 2. Needless to say, as an alternative, the film layer 5 may be arranged between the base body 2 and the second batt layer 3B. As a further alternative, the film layer 5 may be arranged within the first batt layer 3A. Neither of these alternative arrangements is shown in the drawings.

Plural pieces may be piled up to form the film layer 5. It is also possible to arrange the batt layer between those plural pieces of the film layer 5. Similarly, plural pieces may be piled up to form the base body 2; and a film layer 5 may be arranged between those plural pieces of the base body.

Figure 3:
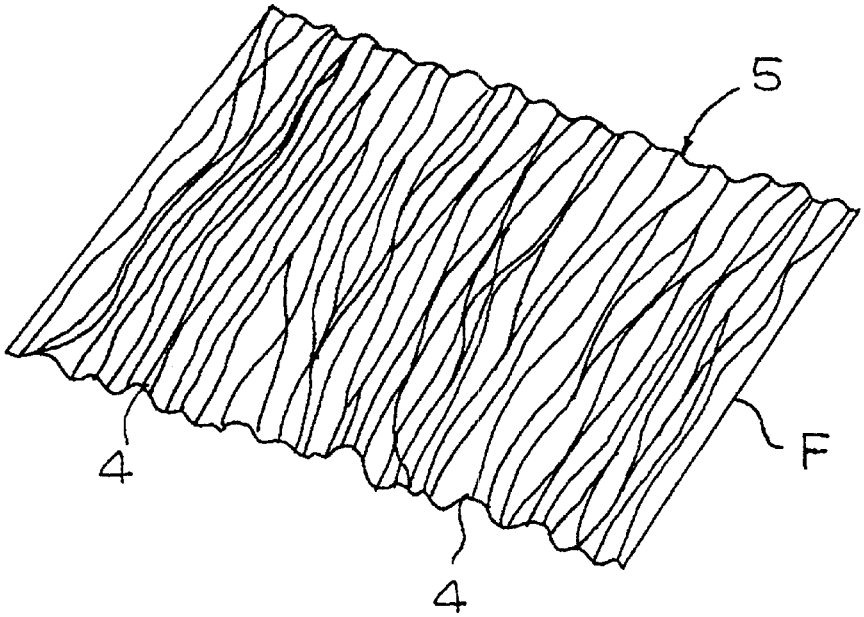
FIG. 3 is a perspective view of the film layer having elongate ridges formed by creping.
Figure 4A:
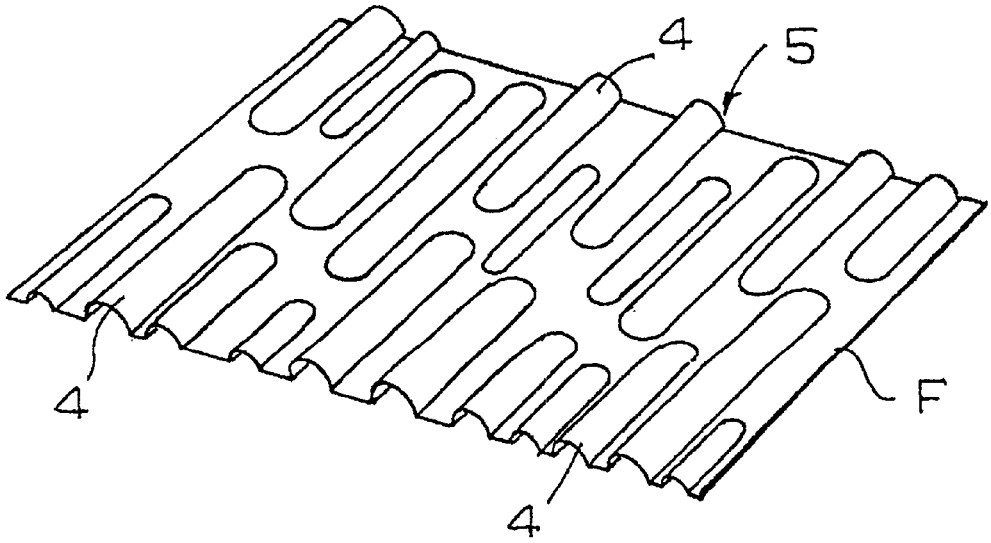
FIG. 4(*a*) is a perspective view of the film layer having elongate ridges formed by embossing, in which the elongate ridges are formed on only one side of the film.
Figure 4B:
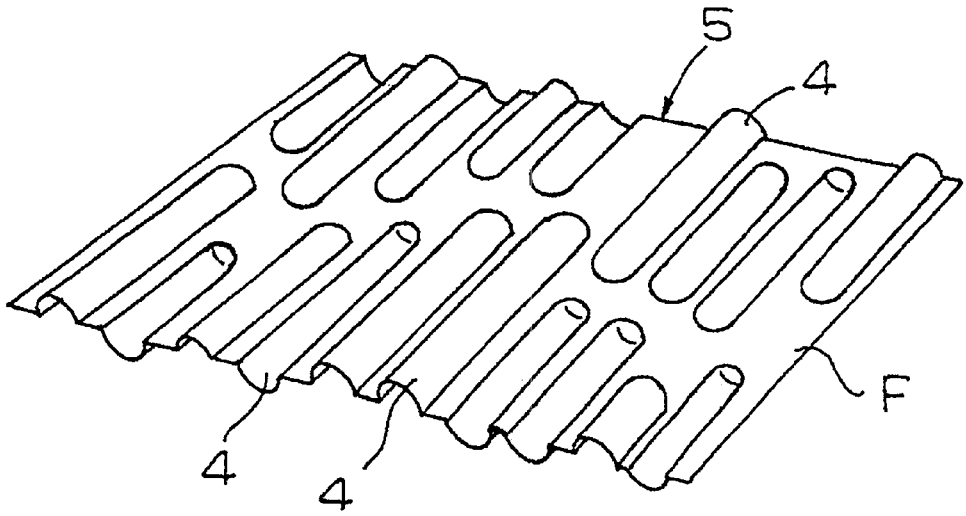
Figure 5:
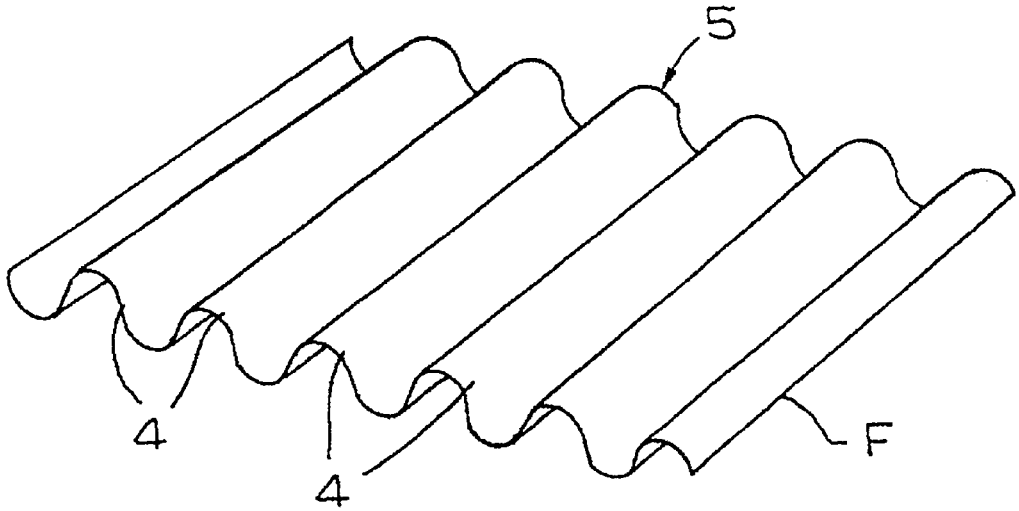
FIG. 5 is a perspective view of a film layer having elongate ridges formed by embossing a wave-like series of rounded grooves.
Figure 6:
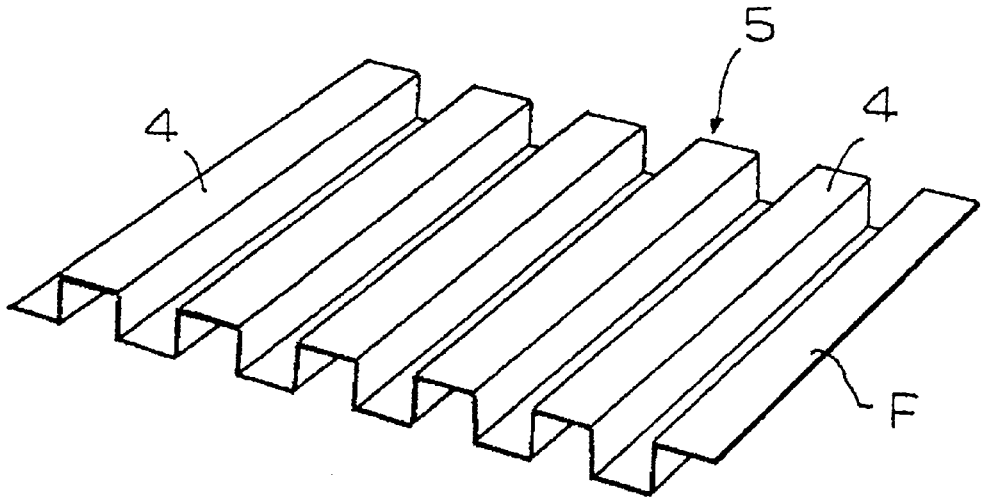
FIG. 6 is a perspective view of the film layer having elongate ridges formed by embossing a rack-like series of rectangular grooves.

The elongate ridges 4, with their orientation in the CMD direction of the film layer 5, appear irregularly and consecutively in FIGS. 3, 4(*a*) and 4(*b*), but they appear regularly and consecutively in FIGS. 5 and 6.

The term "orientation" as used herein with reference to the elongate ridges 4 means the direction as a whole of those elongate ridges 4, and not the directions of the individual ridges. In other words, if the orientation of the elongated ridges as a whole is in the CMD direction, the orientation of the ridges is considered to be in the CMD direction even if a part of the elongate ridges is not oriented in the CMD direction.

There is no special limitation on the materials of the film layer 5. However, from the viewpoint of maintaining the initial shape of the elongate ridges 4 of the film layer, it will be advantageous for the film layer to be formed of elastomeric materials. Polyelastomers, such as, polyurethanes, polyamides, polyesters, polystyrenes, and polyolefins, etc., natural rubbers, such as, IR (isoprene rubber), as well as synthetic rubbers, such as, SBR (styrene butadiene rubber), BR (butadiene rubber), IIR (butyl rubber), CR (chloroprene rubber), and NBR (nitrile rubber) are examples of elastomeric materials.

The hardness of the film layer 5 is desirably from 70–90 in JISA (JIS K6301) and from 30–80 in Shore D. The thickness of the film should be from 20 to 1000 microns, and desirably in the range from 100 to 500 microns.

The areal weight ratio of the film layer 5 to the base body 2 should be in the range from 10–200%, and it has been confirmed by experiment that the areal weight ratio range of 50–150% is especially desirable. Plural pieces may be piled up to form a film layer 5 so as to meet the areal weight ratio requirements.

The elongate ridges 4, with their orientation in the CMD direction of the film layer 5, are provided for the following reasons.

A papermaking felt is used in a papermaking machine in such a way that the felt spans supporting rolls with tension and is adapted to run in a winding path defined by the rolls. So long as the elongate ridges 4 of the film layer 5 have their orientation in the CMD direction, the felt is capable of running flexibly and smoothly on the turning sections of the rolls. As noted previously, it is sufficient that the elongate ridges 4 of the film layer 5 be generally oriented in the CMD direction, and they need not be completely and individually parallel with the CMD direction.

FIGS. 3–7 show specific examples of film layers 5 in which the elongate ridges 4 are formed with their orientation in the CMD direction. The elongate ridges 4 of the film layer 5 may be formed by creping (as generally used in paper processing) or crimp processing (a method for generating crimp by passing film material in a heated atmosphere into a stuffer box). As seen from FIG. 3, the elongate ridges 4, formed by creping or crimp processing, are not only irregularly formed, but the highest point or peak of each elongate ridge 4, as well as the length thereof, are random. The irregular formation of the ridges, their random length, and the random location of the peaks, are effective to inhibit markings from appearing on a wet web.

The elongate ridges 4 of the film layer 5 may be formed by embossing (a method in which a material film is placed between metallic dies to form projections and concavities). The elongate ridges formed by embossing appear, either on one side only as seen from FIG. 4(*a*), or on both sides as seen from FIG. 4(*b*).

As shown in FIGS. 5 and 6, the elongate ridges 4 may take the form of a wavy plate having pleats formed by a series of repeated round grooves in the film material F, or pleats formed by a series of repeated rectangular grooves. However, in case of these pleats, the adjacent ridge lines do not need to be completely parallel so long as deviations from parallelism do not hinder the smooth running of the felt. Embossing permits the forms of the elongate ridges 4 to be chosen freely, which is advantageous from the viewpoint of ease of production and reduction of manufacturing costs.

Figure 7A:
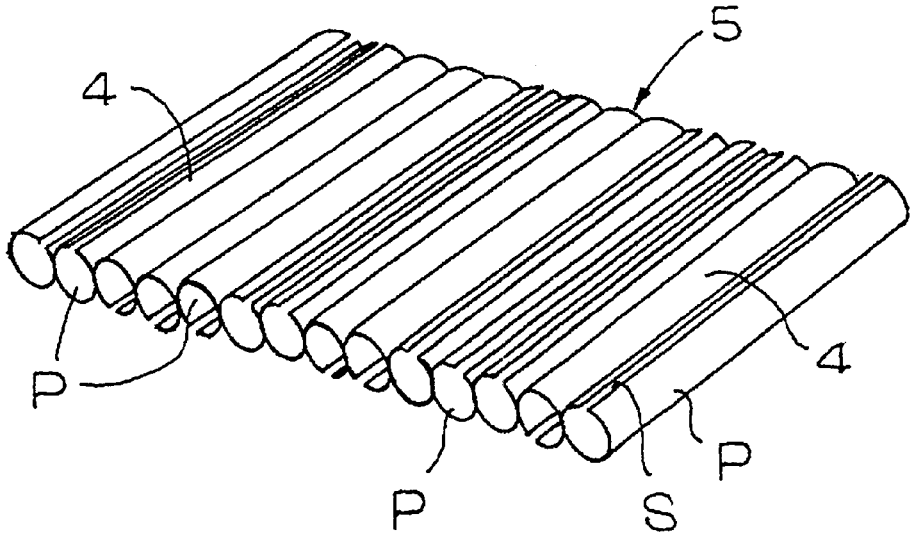
FIG. 7(*a*) is a perspective view of a film layer with elongate ridges formed by bonding, a series of split tubes.
Figure 7B:
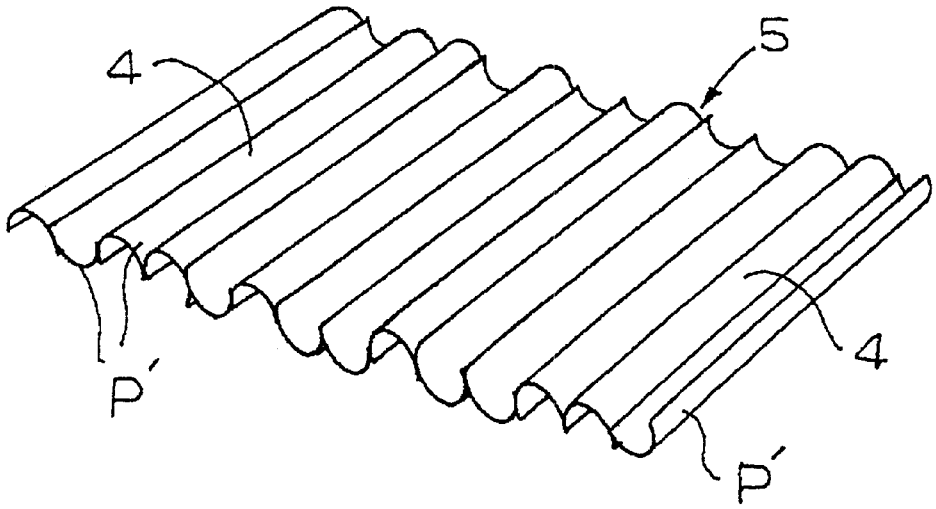

In addition, the film layer 5 may be formed by bonding. For instance, as shown in FIG. 7(*a*), pipe-like elements P, each having a slit S, are placed on a plane and bonding may be performed at the contact lines of these pipe materials P. Alternatively, as shown in FIG. 7(*b*), half-split pipe-like elements P' are placed on a plane, and bonding may be performed at the contact lines of these pipe-like elements P'. The elongate ridges 4 may also be formed in this way.

Figure 8:
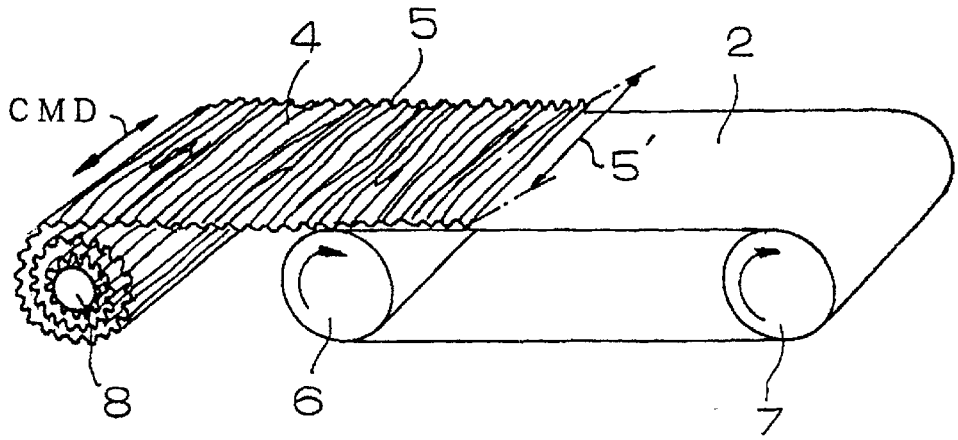
FIG. 8 is a perspective view showing a process for manufacturing a papermaking felt in accordance with the invention.

As shown in FIG. 8, to manufacture a papermaking felt in accordance with the invention, an endless base body 2 is first arranged to span rolls 6 and 7, and tension is applied thereto. Next, referring to FIG. 1, a second batt layer 3B, which consists of short fibers, is put on the base body 2, and the second batt layer and base body are intertwined by needling.

After the base body 2 is intertwined with the second batt layer 3B, the intertwined layers are detached from the rolls 6 and 7, and turned inside-out so that the inside and outside are reversed. The reversed product is again arranged to span the rolls 6 and 7, and tension is applied. A third batt layer 3C is applied to the intertwined base body and second batt layer. Then, as illustrated in FIG. 8, film layer 5, which is reeled on a roll 8 with its elongate ridges 4 formed beforehand, is supplied on roll 8 so that the elongate ridges 4 are disposed in the CMD direction as indicated by the double-ended arrow in FIG. 8. In the present embodiment, the width 5' of the film layer 5 is set greater than the width of the wet web that is to be drained.

When the film layer 5 is applied to the base body 2 between the rolls 6 and 7, the film layer 5 is drawn out from the roll 8, and the starting end thereof is fixed with an adhesive tape (not shown) etc. at a particular location on the base body 2. Next, the rolls 6 and 7 are rotated so that the film layer 5 extends over the entire base body 2. Then, the film layer 5 is cut at the position at which it meets the starting end, the other end is placed in opposed relation to the starting end, and then, the other end is fixed to the base body 2 by an adhesive tape.

Thereafter, a first batt layer 3A is accumulated on the film layer 5, and all the layers are intertwined by needling. At the time needling takes place, the needles perforate the film layer 5 with the short fibers hung on them. The film layer 5 is water-permeable because of the pores formed by the needling action. Thus, there is no concern that water permeability will be lost by the use of the film layer 5.

A third batt layer 3C may be formed between the film layer 5 and the base body 2 by the movement of the short fibers as result of needling. In this case, separate accumulation of the third batt layer 3C may be omitted.

As mentioned above, after the base body 2 and the film layer 5, as well as the first to third batt layers 3A, 3B, 3C, have been integrated by needling to effect intertwining, both sideward ends are cut. The adhesive tapes, used when the film layer 5 is installed on the base body 2, are removed at the same time. The paper-making felt 1 of the invention is thereby completed.

Figure 9:
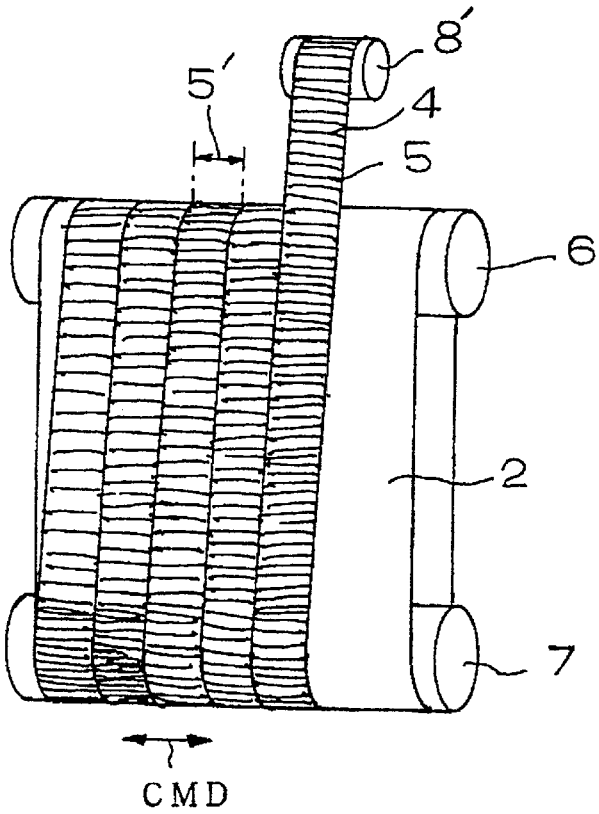
FIG. 9 is a perspective view showing another process for manufacturing the papermaking felt of the invention.
Figure 12:
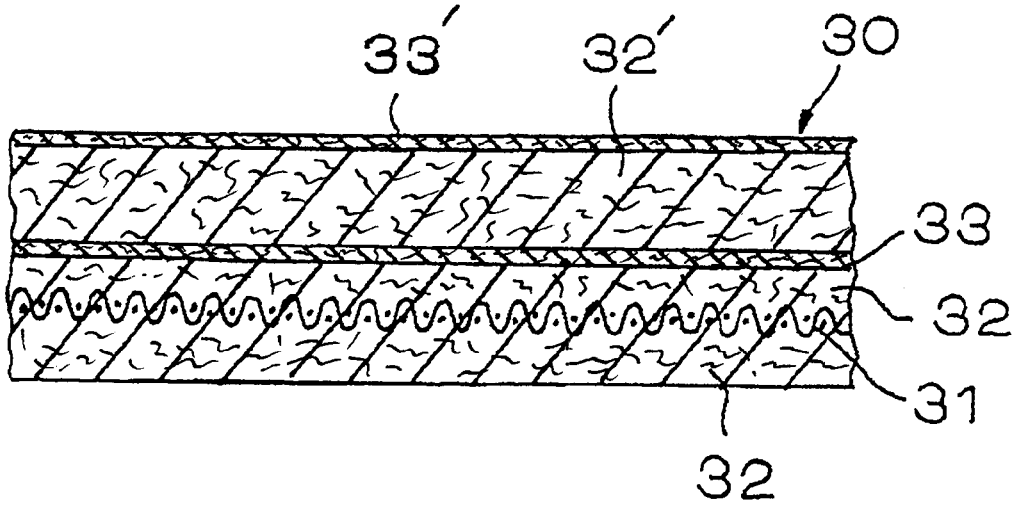
PRIOR ART FIG.12
FIG. 12 is a sectional view of a previous papermaking felt proposed by the inventor hereof.

In making the papermaking felt 1 of the above-described embodiment, the width of the film layer 5 is made greater than the width of the wet web to be drained. However, as shown in FIG. 9, and as explained below, it is possible to use a film layer 5, having a width 5' that is less than the width of the wet web that is to be drained of water.

In this case, the starting end of the film layer 5 drawn out from a roll 8' is fixed to the base body 2, at a location near one of the sides of the base body, by an adhesive tape or other suitable fastening technique. By rotating the rolls 6 and 7, the film layer 5 is spirally wound on the base body 2 so that the adjacent side edges of the film layer 5 abut each other. Upon completion of the winding operation, when the film layer covers substantially the entire base body 2, the film layer 5 is cut at a position which corresponds to the position of the starting end. The terminating end is fixed to the base body 2 with an adhesive tape or other suitable fastening means.

When the film layer 5 is spirally wound as illustrated, the ridge lines of the elongate ridges intended to have their orientation of the CMD direction are not exactly parallel with the CMD direction of the papermaking felt 1, but are nearly parallel thereto as shown in the drawing. However, this minor deviation from parallelism between the ridges and the CMD direction does not cause a problem so long as it does not hinder the smooth running of the papermaking felt.

If it is desired that the ridge lines more nearly coincide with the CMD direction of the machine, depending upon the film thickness or the size of the elongate ridges, a more nearly parallel relation between the ridges and the CMD direction may be realized by calculating the angle of the spiral and compensating for this angle by forming the ridges at a corresponding angle of inclination relative to the direction of the length of the film.

The papermaking felt 1 of the invention, which is composed of a base body 2 and batt layers 3, is characterized in that a film layer, with elongate ridges having their orientation in the CMD direction, are arranged in the base body or batt layers or between the layers. Thus, the papermaking felt of the invention is capable of running flexibly and smoothly in the winding path of a paper-making machine and resists becoming flat by fatigue, even if subjected to repeated compression by the action of the nip pressure.

The following are examples of papermaking felts in accordance with the invention, along with a comparative example.

EXAMPLE 1

Total areal weight of the papermaking felt=990 g/m$^2$ (1) Base body (plain weave of monofilament twine): Areal weight=300 g/m$^2$ (2) Batt layer (short fiber of nylon 6): Total areal weight=550 g/m$^2$ (the 1st batt layer 3A, areal weight=350 g/m$^2$; the 2nd batt layer 3B, areal weight=100 g/m$^2$; the 3rd batt layer 3C, areal weight=100 g/m$^2$)

(3) Film layer (Mobilon Film MF100-T made by Nisshimbo Company): Hardness 78 (JIS A); and crepe number (number of crests/100 mm)=25, areal weight=140 g/m$^2$ (4) Areal weight ratio of the film layer to the base body=46%

EXAMPLE 2

Total areal weight of the papermaking felt=990 g/m$^2$ (1) Base body (plain weave of monofilament twine): areal weight=300 g/m$^2$ (2) Batt layer (short fiber of nylon 6): Total areal weight=540 g/m$^2$ (the 1st batt layer 3A, areal weight=340 g/m$^2$; the 2nd batt layer 3B, areal weight=100 g/m$^2$; the 3rd batt layer 3C, areal weight=100 g/m$^2$)

(3) Film layer (Mobilon Film MF100-T made by Nisshimbo Company): Hardness 78 JIS A); crepe number (number of crests/100 mm)=50, areal weight=150 g/m$^2$ (4) Areal weight ratio of the film layer to the base body=50%

EXAMPLE 3

Total areal weight of the papermaking felt=990 g/m$^2$ (1) Base body (plain weave of monofilament twine): Areal weight=300 g/m$^2$ (2) Batt layer (short fiber of nylon 6): Total areal weight=525 g/m$^2$ (the 1st batt layer 3A, areal weight=325 g/m$^2$; the 2nd batt layer 3B, areal weight=100 g/m$^2$; the 3rd batt layer 3C, areal weight=100 g/m$^2$)

(3) Film layer (Mobilon film MF100-T made by Nisshimbo Company): Hardness 78 (JIS A); crepe number (number of crests/100 mm)=100; areal weight=165 g/m$^2$ (4) Areal weight ratio of the film layer to the base body=110%.

EXAMPLE 4

Total areal weight of the papermaking felt=1070 g/m$^2$ (1) Base body (plain weave of monofilament twine): Areal weight=300 g/m$^2$ (2) Batt layer (short fiber of nylon 6): Total areal weight=400 g/m$^2$ (the 1st batt layer 3A, areal weight=200 g/m$^2$; the 2nd batt layer 3B, areal weight=100 g/m$^2$; the 3rd batt layer 3C, areal weight=100 g/m$^2$)

(3) Film layer (Mobilon Film MF300-T made by Nisshimbo Company): Hardness 78 JIS A); crepe number (number of crests/100 mm)=20; areal weight=370 g/m$^2$ (4) Areal weight ratio of the film layer to the base body=123%

EXAMPLE 5

Total areal weight of the papermaking felt=1070 g/m$^2$ (1) Base body (plain weave of monofilament twine): Areal weight=300 g/m$^2$ (2) Batt layer (short fiber of nylon 6): Total areal weight=390 g/m$^2$ (the 1st batt layer 3A, areal weight=190 g/m$^2$; the 2nd batt layer 3B, areal weight=100 g/m$^2$; the 3rd batt layer 3C, areal weight=100 g/m$^2$)

(3) Film layer (Mobilon Film MF300-T made by Nisshimbo Company: Hardness 78 JIS A); crepe number (number of crests/100 mm)=40; areal weight=380 g/m$^2$ (4) Areal weight ratio of the film layer to the base body=127%

EXAMPLE 6

Total areal weight of papermaking felt=1070 g/m$^2$ (1) Base body (plain weave of monofilament twine): Areal weight=300 g/m$^2$ (2) Batt layer (short fiber of nylon 6): Total areal weight=380 g/m$^2$ (the 1st batt layer 3A, areal weight=180 g/m$^2$; the 2nd batt layer 3B, areal weight=100 g/m$^2$; the 3rd batt layer 3C, areal weight=100 g/m$^2$)

(3) Film layer (Mobilon Film MF300-T made by Nisshimbo Company): Hardness 78 JIS A; crepe number (number of crests/100 mm)=60, areal weight=390 g/m$^2$ (4) Areal weight ratio of the film layer to the base body=130%

COMPARATIVE EXAMPLE 1

Total areal weight of the papermaking felt=1070 g/m$^2$ (1) Base body (plain weave of monofilament twine): Areal weight=440 g/m$^2$ (2) Batt layer (short fiber of nylon 6): total areal weight=550 g/m$^2$; wet web side, areal weight=450 g/m$^2$; roll side, areal weight=100 g/m$^2$ In the above Examples 1–6, the Mobilon Films, MF100-T and MF300-T, used as the film layers were thermoplastic polyurethane films manufactured by T-die extrusion method, and their physical properties are as shown in FIG. 10. Fatigue resistance evaluation and water permeability evaluation were conducted for examples 1–6 and the comparative example 1. The fatigue resistance evaluation was done on the basis of the values for the density of the felt/initial density, after the pulse load of 150 kg/cm$^2$ at 10 Hz was repeated 200,000 times. The evaluation of water permeability was derived from the amount in a vertical filtrate water which passed the felt under 150 kg/cm$^2$ pressure. The result is shown in FIG. 11.

As shown in FIG. 11, examples 5 and 6 were the best in terms of fatigue resistance, and examples 3 and 4 were the second best, with examples 1 and 2 ranking 3rd and 4th, respectively. The comparative example was the lowest in fatigue resistance. The fatigue resistance evaluation confirmed that the papermaking felt of the invention is possessed of superior fatigue resistance owing to the characteristic film layer.

Examples 1 and 2 as well as the comparative example were excellent in water permeability. Examples 3 and 4 ranked second; and the examples 5 and 6 ranked lowest. It was determined, however, that the water permeability performance of examples 5 and 6 would not pose a problem in actual use.

As explained hereinabove, the papermaking felt of the invention is capable of running flexibly and smoothly in the winding path of a papermaking machine, and is resists flattening by fatigue even when subjected to repeated compression under the nip pressure.

If the film layer of the papermaking felt consists of an elastic material, the film layer is capable of maintaining the initial configuration for a longer time, thereby achieving very superior performance.

If the elongate ridges of the film layer, which are oriented in the CMD direction, are formed by creping, the ridges may be arranged irregularly, with the height of their peaks and their lengths made random by the forming process itself. The creped film thus provides superior results in terms of manufacture as well as high performance.

If the elongate ridges oriented in the CMD direction are formed by embossing, they may be formed easily with a comparatively low manufacturing cost, which is also highly advantageous.

I claim

1. A papermaking felt comprising a base body, batt layers, and a film layer arranged in the base body, in the batt layers, or between the batt layers, wherein the improvement comprises an irregular formation of elongate ridges in the film layer, the ridges being oriented in the CMD direction and having random lengths and randomly located peaks.

2. A papermaking felt of claim 1, wherein the elongate ridges of the film layer are formed by creping.

3. A papermaking felt of claim 1, wherein the film layer comprises an elastic material.

4. A papermaking felt of claim 3, wherein the elongate ridges of the film layer are formed by creping.

5. A papermaking felt of claim 1, wherein said peaks are of random height.

6. A papermaking felt of claim 3, wherein said peaks are of random height.

* * * * *